US012630384B2

(12) United States Patent
Noso et al.

(10) Patent No.: US 12,630,384 B2
(45) Date of Patent: May 19, 2026

(54) POST-PROCESSING APPARATUS AND IMAGE FORMING SYSTEM

(71) Applicant: KYOCERA Document Solutions Inc., Osaka (JP)

(72) Inventors: Terumitsu Noso, Osaka (JP); Yasunori Ueno, Osaka (JP); Yusuke Takano, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 19/215,863

(22) Filed: May 22, 2025

(65) Prior Publication Data

US 2025/0376347 A1 Dec. 11, 2025

(30) Foreign Application Priority Data

Jun. 5, 2024 (JP) ..... 2024-091404

(51) Int. Cl.

| | |
|---|---|
| ***B65H 31/02*** | (2006.01) |
| ***B65H 29/14*** | (2006.01) |
| ***B65H 31/36*** | (2006.01) |
| ***B65H 37/04*** | (2006.01) |
| ***B65H 43/00*** | (2006.01) |

(52) U.S. Cl.

CPC ..... *B65H 31/02* (2013.01); *B65H 29/145* (2013.01); *B65H 31/36* (2013.01); *B65H 37/04* (2013.01); *B65H 43/00* (2013.01); *B65H 2301/163* (2013.01); *B65H 2301/4212* (2013.01); *B65H 2301/4213* (2013.01); *B65H 2403/942* (2013.01); *B65H 2404/1441* (2013.01); *B65H 2404/1451* (2013.01); *B65H 2404/1521* (2013.01); *B65H 2405/11151* (2013.01); *B65H 2513/11* (2013.01); *B65H 2515/34* (2013.01); *B65H 2801/27* (2013.01)

(58) Field of Classification Search

CPC ..... B65H 31/02; B65H 31/36; B65H 2404/1521; B65H 31/3027; B65H 29/145

See application file for complete search history.

(56) References Cited

U.S. PATENT DOCUMENTS

| | | | | |
|---|---|---|---|---|
| 10,351,382 | B2 * | 7/2019 | Moriya | B65H 31/08 |
| 11,603,281 | B2 * | 3/2023 | Iwama | B65H 31/36 |

FOREIGN PATENT DOCUMENTS

JP 2006-248686 A 9/2006

* cited by examiner

*Primary Examiner* — Jeremy R Severson

(74) *Attorney, Agent, or Firm* — Stein IP, LLC

(57) ABSTRACT

A post-processing apparatus includes a conveyance portion, a processing tray, a post-processing portion, a discharge tray, a discharge portion, and a control portion. The discharge portion includes an arm, a driving roller, and a driven roller. When stacking a sheet on the processing tray, the control portion brings the driving roller into contact with the sheet. Except when the sheet as the target of post-processing is retracted onto the processing tray, the control portion sets the downward movement speed of the driving roller to a normal speed. When the sheet as the target of post-processing is retracted onto the processing tray, the control portion sets the downward movement speed of the driving roller to a speed lower than the normal speed.

8 Claims, 6 Drawing Sheets

POST-PROCESSING APPARATUS AND IMAGE FORMING SYSTEM

INCORPORATION BY REFERENCE

This application is based on and claims the benefit of priority from Japanese Patent Application No. 2024-091404 filed on Jun. 5, 2024, the contents of which are hereby incorporated by reference.

BACKGROUND

The present disclosure relates to a post-processing apparatus and an image forming system.

Conventional post-processing apparatuses include a processing tray. The processing tray has sheets stacked on it as the target of post-processing such as a stapling process. The conventional post-processing apparatus performs post-processing on the bundle of sheets on the processing tray.

SUMMARY

According to a first aspect of the disclosure, a post-processing apparatus includes a conveyance portion, a processing tray, a post-processing portion, a discharge tray, a discharge portion, and a control portion. The conveyance portion conveys a sheet. On the processing tray, the sheet having passed through the conveyance portion can be stacked. The post-processing portion performs post-processing on the sheet on the processing tray. To the discharge tray, the sheet is discharged. The discharge portion is disposed downstream of the conveyance portion in the sheet conveyance direction and discharges the sheet to the discharge tray. The control portion controls the discharge portion. The discharge portion includes an arm, a driving roller, and a driven roller. The arm is pivotable such that, about its one end part, the other end part of it is movable up and down. The driving roller is supported on the other end part of the arm so as to be rotatable and makes contact with the sheet from above and rotates forward so as to discharge the sheet to the discharge tray. The driven roller is disposed below the driving roller across the sheet conveyance passage and nips the sheet with the driving roller as the driving roller moves downward. When stacking the sheet on the processing tray, the control portion moves the driving roller downward to bring, from above, the driving roller into contact with the sheet having passed through the conveyance portion and rotates the driving roller backward so as to retract the sheet from its trailing edge onto the processing tray. Except when the sheet as the target of post-processing is retracted onto the processing tray, the control portion sets the downward movement speed of the driving roller to a predetermined normal speed. When the sheet as the target of post-processing is retracted onto the processing tray, the control portion sets the downward movement speed of the driving roller to a speed lower than the normal speed.

According to a second aspect of the disclosure, an image forming system includes the post-processing apparatus described above and an image forming apparatus. The image forming apparatus forms an image on the sheet. The post-processing apparatus performs post-processing on the sheet conveyed from the image forming apparatus.

DETAILED DESCRIPTION

Figure 1:
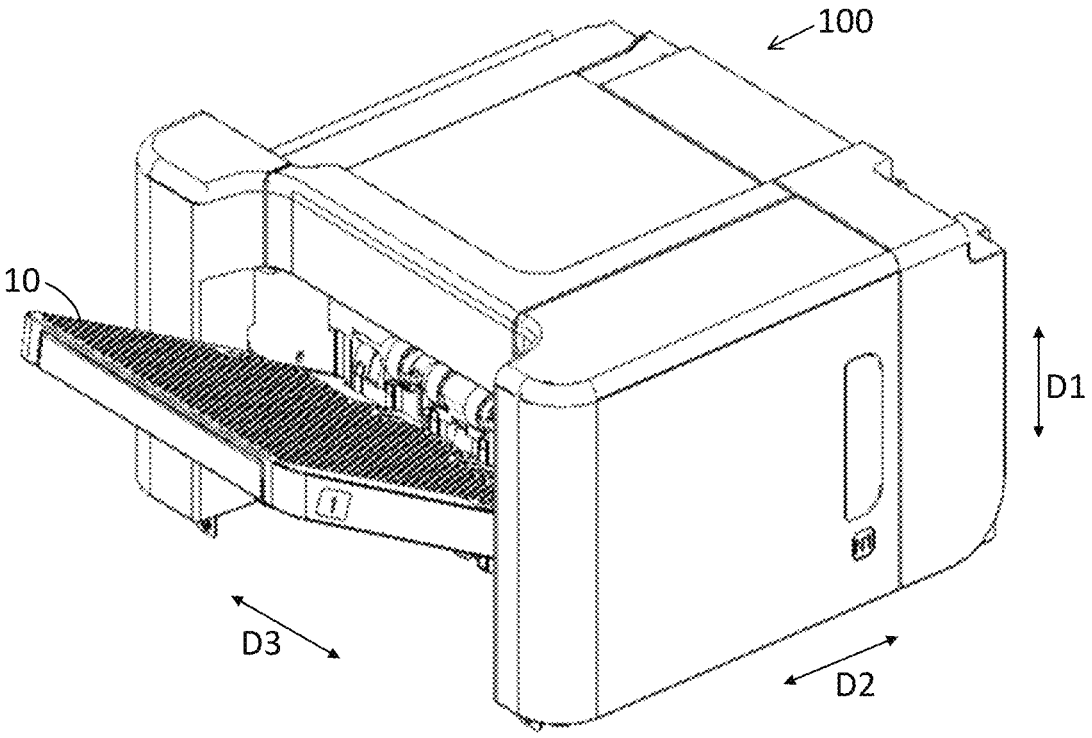
FIG. 1 is a perspective view of a post-processing apparatus according to an embodiment.
Figure 2:
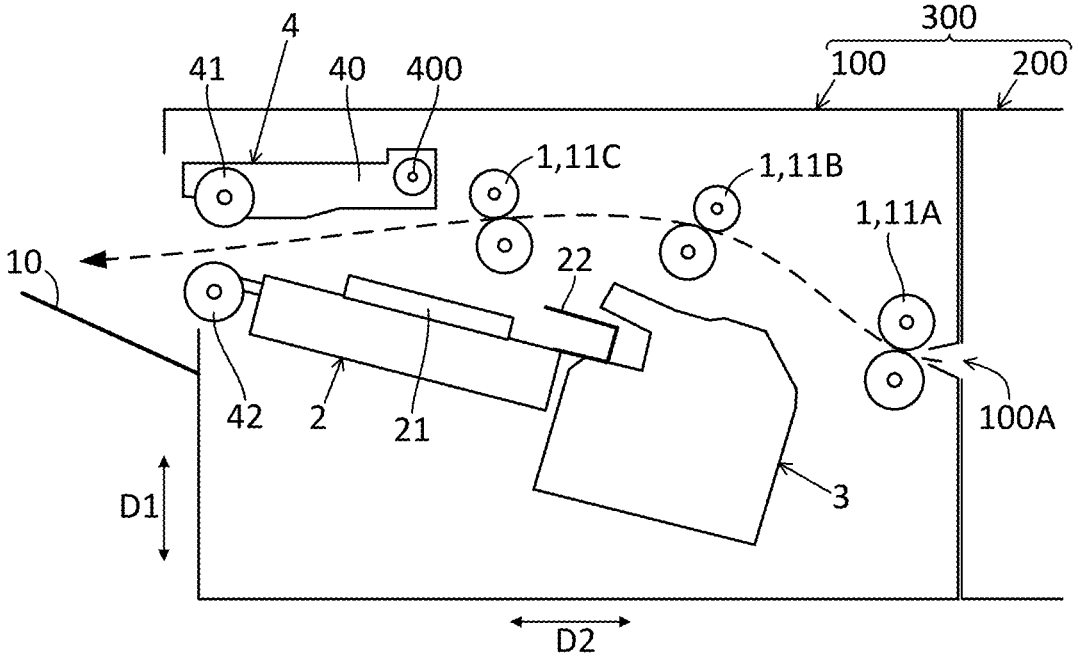
FIG. 2 is a schematic diagram showing the internal structure of the post-processing apparatus according to the embodiment.

Configuration of Post-processing Apparatus: A post-processing apparatus 100 according to an embodiment has an exterior appearance as shown in FIG. 1. As shown in FIG. 2, the post-processing apparatus 100 can be coupled with an image forming apparatus 200. The image forming apparatus 200 performs a printing job in which it forms an image on a sheet S. For example, the image forming apparatus 200 is an inkjet recording apparatus. That is, the image forming apparatus 200 ejects ink onto the sheet S to form an image with the ink on the sheet S. The post-processing apparatus 100 is coupled with the image forming apparatus 200 to constitute an image forming system 300 together with the image forming apparatus 200.

The top-bottom direction of the post-processing apparatus 100 is the direction indicated by arrow D1. The left-right direction of the post-processing apparatus 100 is the direction indicated by arrow D2. The front-rear direction of the post-processing apparatus 100 is the direction perpendicular to the plane of FIG. 2, and thus is the direction indicated by arrow D3 in FIG. 1. FIG. 2 shows the inside of the post-processing apparatus 100 as seen from the front-rear direction. In the following description, the right side of FIG. 2 is defined as the right side of the post-processing apparatus 100 and the left side of FIG. 2 is defined as the left side of the post-processing apparatus 100.

The post-processing apparatus 100 has a conveying port 100A in its right side face. The post-processing apparatus 100 conveys into it the printed sheet S (i.e., the sheet S with the image formed on it) from the image forming apparatus 200 via the conveying port 100A. In addition, the post-processing apparatus 100 includes a discharge tray 10. The discharge tray 10 is disposed on the left side of the post-processing apparatus 100. The post-processing apparatus 100 conveys the sheet S conveyed into it via the conveying port 100A to the discharge tray 10 to discharge it. In FIG. 2, the sheet conveyance passage is indicated by an arrowed broken line. After being conveyed into the post-processing apparatus 100, the sheet S is conveyed from the right side to the left side of the post-processing apparatus 100.

The post-processing apparatus 100 includes a conveyance portion 1. The conveyance portion 1 includes a plurality of pairs of conveying rollers 11. Three of the pairs of conveying rollers 11 are provided. In the following description, whenever needed, the three pairs of conveying rollers 11 are distinguished with different alphabetical letters appended to their reference signs.

The three pairs of conveying rollers 11 are supported such that each roller is rotatable about an axis extending along the front-rear direction. The three pairs of conveying rollers 11 each include a pair of rollers kept in pressed contact with each other. One rollers in the pairs are coupled with a single conveyance motor FM (see FIG. 3) and rotates with the motive power transmitted from the conveyance motor FM. The other rollers in the pairs rotate by following the rotation of the one rollers with which they are in pressed contact. The three pairs of conveying rollers 11 each nip the sheet S between the pair of rollers and rotate to convey the sheet S.

The pairs of conveying rollers 11A, 11B, and 11C are disposed in this order from upstream to downstream in the sheet conveyance direction. In this configuration, of the three pairs of conveying rollers 11 in the conveyance portion 1, the pair of conveying rollers 11C is the pair of conveying rollers 11 disposed most downstream in the sheet conveyance direction. Note that there is no limitation on the number of pairs of conveying rollers 11 disposed. Any modification can be made on the number of pairs of conveying rollers 11 disposed depending on the length of the sheet conveyance passage or the like. The number of pairs of conveying rollers 11 disposed can be four or more, or two or less.

The post-processing apparatus 100 includes a processing tray 2. The processing tray 2 is disposed at a position where the sheet S having passed through the pair of conveying rollers 11C in the conveyance portion 1 can be stacked. Specifically, the processing tray 2 is inclined obliquely downward from downstream to upstream in the sheet conveyance direction. In addition, a slope-top end part of the processing tray 2 is located downstream of the pair of conveying rollers 11C in the sheet conveyance direction. A slope-bottom end part of the processing tray 2 is located upstream of the pair of conveying rollers 11C in the sheet conveyance direction (i.e., rightward of the pair of conveying rollers 11C), below the pair of conveying rollers 11C along the top-bottom direction. In this configuration, after the trailing edge of the sheet S has passed through the pair of conveying rollers 11C, the sheet S is switched back so as to be stacked on the processing tray 2.

In post-processing, a plurality of sheets S are stacked on the processing tray 2. The post-processing is performed on a bundle of sheets S on the processing tray 2. The details will be described later.

The post-processing apparatus 100 includes a pair of cursors 21. The pair of cursors 21 are fitted to the processing tray 2. The pair of cursors 21 are disposed at an interval from each other along the front-rear direction. The pair of cursors 21 are supported so as to be reciprocatable along the front-rear direction. The pair of cursors 21 lie on opposite sides of the sheets S on the processing tray 2 along the front-rear direction. This allows the alignment of the plurality of sheets S on the processing tray 2 along the front-rear direction.

The post-processing apparatus 100 includes a reference plate 22. The reference plate 22 is fitted to the processing tray 2. The reference plate 22 is disposed at the slope-bottom side of the processing tray 2. With the sheets S stacked on the processing tray 2, the trailing edges of the sheets S are in contact with the reference plate 22. This allows the alignment of the trailing edges of the plurality of the sheets S on the processing tray 2.

The post-processing apparatus 100 includes a stapler 3. The stapler 3 is disposed at the slope-bottom side of the processing tray 2. The stapler 3 performs a staling process in which it binds the bundle of sheets S on the processing tray 2 with a staple. The stapling process by the stapler 3 is post-processing that can be performed on the post-processing apparatus 100. The stapler 3 corresponds to a "post-processing portion."

The post-processing apparatus 100 includes a discharge portion 4. The discharge portion 4 is disposed downstream of the conveyance portion 1 in the sheet conveyance direction. The discharge portion 4 performs a discharging process in which it discharges the sheet S (including the bundle of sheets S on the processing tray 2) to the discharge tray 10.

The discharge portion 4 includes an arm 40. The arm 40 is disposed above the sheet conveyance passage. The arm 40 extends along the left-right direction as seen from the front-rear direction. The arm 40 has a rotation shaft 400 in a right end part of it (corresponding to "one end part"). The rotation shaft 400 of the arm 40 extends along the front-rear direction. The arm 40 is pivotable such that, about the rotation shaft 400 in its right end part, its left end part (corresponding to "another end part") moves up and down. As the rotation shaft 400 rotates, the arm 40 moves its left end part up and down.

The discharge portion 4 includes a driving roller 41. The driving roller 41 is disposed above the sheet conveyance passage. The driving roller 41 is rotatably supported in the left end part of the arm 40. The driving roller 41 is rotatable about an axis extending along the front-rear direction. The driving roller 41, supported in the left end part of the arm 40, can move up and down together with the left end part of the arm 40.

The discharge portion 4 includes a driven roller 42. The driven roller 42 is disposed below the driving roller 41 across the sheet conveyance passage. Specifically, the driven roller 42 is disposed at the slope-top side of the processing tray 2. The driven roller 42 is supported so as to be rotatable about an axis extending along the front-rear direction. The driven roller 42 can be rotatably supported on the slope-top end part of the processing tray 2.

The driving roller 41 and the driven roller 42 are disposed at positions where they can make pressed contact with each other. Downward movement of the driving roller 41 brings the driving roller 41 and the driven roller 42 into pressed contact with each other. From that state, as the driving roller 41 moves upward, the driving roller 41 moves apart from the driven roller 42.

Figure 3:
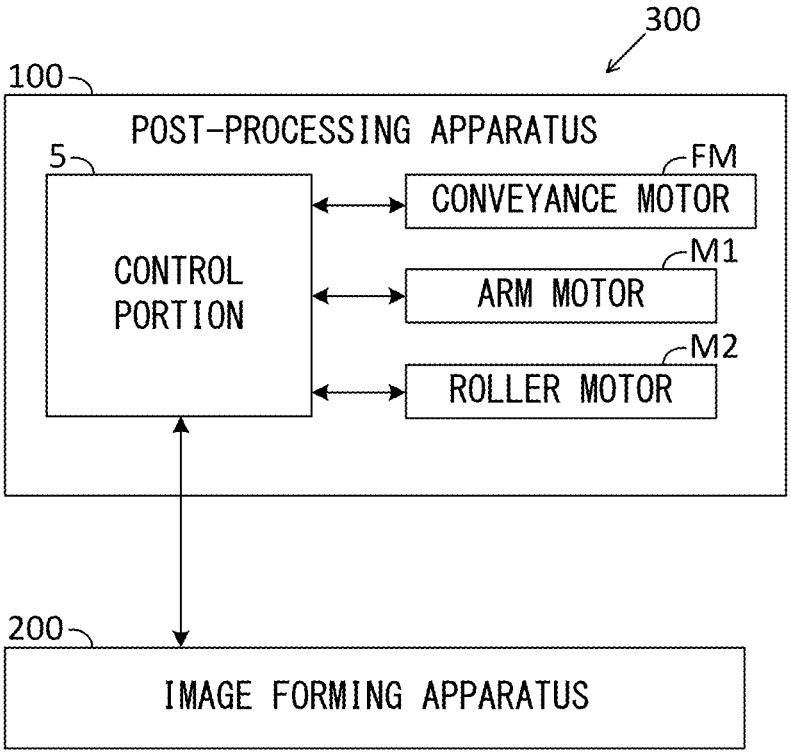
FIG. 3 is a block diagram of the post-processing apparatus according to the embodiment.

The discharge portion 4 includes an arm motor M1 (see FIG. 3). The arm motor M1 is coupled with the rotation shaft 400 of the arm 40 to rotate the rotation shaft 400. That is, the arm motor M1 transmits motive power to the arm 40 so as to move the left end part of the arm 40 up and down.

The discharge portion 4 includes a roller motor M2 (see FIG. 3). The roller motor M2 is coupled with the driving roller 41 (its rotation shaft). The driving roller 41 rotates with motive power transmitted from the roller motor M2. The driven roller 42 rotates by following the rotation of the driving roller 41.

As shown in FIG. 3, the post-processing apparatus 100 also includes a control portion 5. The control portion 5 includes processing circuits such as a CPU and an ASIC. The control portion 5 also includes storage devices such as a ROM and a RAM.

The control portion 5 controls the conveyance of the sheet S by the conveyance portion 1. That is, the control portion 5 controls the conveyance motor FM.

For example, the sheet conveyance passage can be provided with a conveyance sensor (not shown) that changes its output according to the presence/absence of the sheet S. Usable as the conveyance sensor is an optical sensor having a light emitting portion and a light receiving portion.

The conveyance sensor has its sensing position at a predetermined position on the sheet conveyance passage. With this configuration, based on the timing with which the leading edge of the sheet S arrivals at, or its trailing-edge leaves, the sensing position by the conveyance sensor, the control portion 5 can check whether the trailing edge of the sheets S has passed through the pair of conveying rollers 11C in the conveyance portion 1.

The control portion 5 controls post-processing on the sheet S on the processing tray 2. That is, the control portion 5 controls the stapling process by the stapler 3. The control portion 5 controls a stapler moving mechanism (not shown; a mechanism including a motor and the like) that moves the stapler 3 along the front-rear direction, so that it appropriately moves the stapler 3 along the front-rear direction to change the stapling position. The control portion 5 also judges when to drive a staple into the bundle of sheets S on the processing tray 2.

In addition, the post-processing apparatus 100 can perform a sorting process (shifting process). The sorting process is a process in which the discharging position of the sheets S on the discharge tray 10 is displaced copy by copy along the front-rear direction. By shifting the sheets S on the processing tray 2 along the front-rear direction, it is possible to displace the discharging position of the sheets S on the discharge tray 10 along the front-rear direction. To achieve this, the control portion 5 controls a cursor moving mechanism (not shown; a mechanism including a motor and the like) that moves the pair of cursors 21 along the front-rear direction so as to appropriately move the pair of cursors 21 along the front-rear direction.

With this configuration, even if no stapling process is performed as post-processing, the sheets S can be stacked on the processing tray 2. Note that the bundle of sheets S after the stapling process may be shifted along the front-rear direction.

The control portion 5 controls the discharge portion 4. That is, the control portion 5 not only controls the arm motor M1 but also controls the roller motor M2. The discharge portion 4 controls, in addition to the discharging process of discharging the sheet S to the discharge tray 10, a retracting process of retracting the sheet S onto the processing tray 2 (corresponding to a process of stacking the sheets S onto the processing tray 2).

When the first sheet S in the printing job is conveyed into the post-processing apparatus 100 from the image forming apparatus 200, the control portion 5 makes the discharge portion 4 perform a preparing process. Specifically, the control portion 5 moves the driving roller 41 downward to bring the driving roller 41 and the driven roller 42 into direct pressed contact with each other. The control portion 5 then rotates the driving roller 41 forward. This results in the leading edge of the sheet S being nipped between the driving roller 41 and the driven roller 42, so that the sheet S is conveyed as it is by the driving roller 41 and the driven roller 42.

After that, if the job to be performed is a job involving no post-processing that requires no post-processing, there is no need to retract the sheet S onto the processing tray 2. Thus, in this case, the control portion 5 lets the driving roller 41 and the driven roller 42 continue conveying the first sheet S. Thus the sheet S is discharged to the discharge tray 10. After that, until the completion of the job involving no post-processing, the control portion 5 continues, without moving the driving roller 41 apart from the driven roller 42, the conveyance of the sheet S with the driving roller 41 and the driven roller 42. That is, also the second and subsequent sheets S are, without being retracted onto the processing tray 2, discharged to the discharge tray 10. In some jobs, only one sheet S is processed.

On the other hand, if the job to be performed is a job involving post-processing, the sheet S has to be retracted onto the processing tray 2. Thus, in this case, after the trailing edge of the first sheet S has passed through the pair of conveying rollers 11C in the conveyance portion 1, the control portion 5 makes the discharge portion 4 perform a retracting process, which will now be described in detail. Note that, in the job involving post-processing, a plurality of sheets S are continuously conveyed into the post-processing apparatus 100 from the image forming apparatus 200.

When the job to be performed is a job involving post-processing, after the trailing edge of the first sheet S has passed through the pair of conveying rollers 11C in the conveyance portion 1, before the trailing edge of the first sheet S passes between the driving roller 41 and the driven roller 42, the control portion 5 rotates the driving roller 41 backward. This results in the first sheet S being retracted onto the processing tray 2, so that it is placed on the processing tray 2.

After the first sheet S is placed on the processing tray 2, the control portion 5 moves the driving roller 41 upward to move the driving roller 41 apart from the topmost sheet S (here, the first sheet S) on the processing tray 2. In this state, the conveyance portion 1 conveys the second sheet S. After that, control proceeds as shown in FIG. 4.

Figure 4:
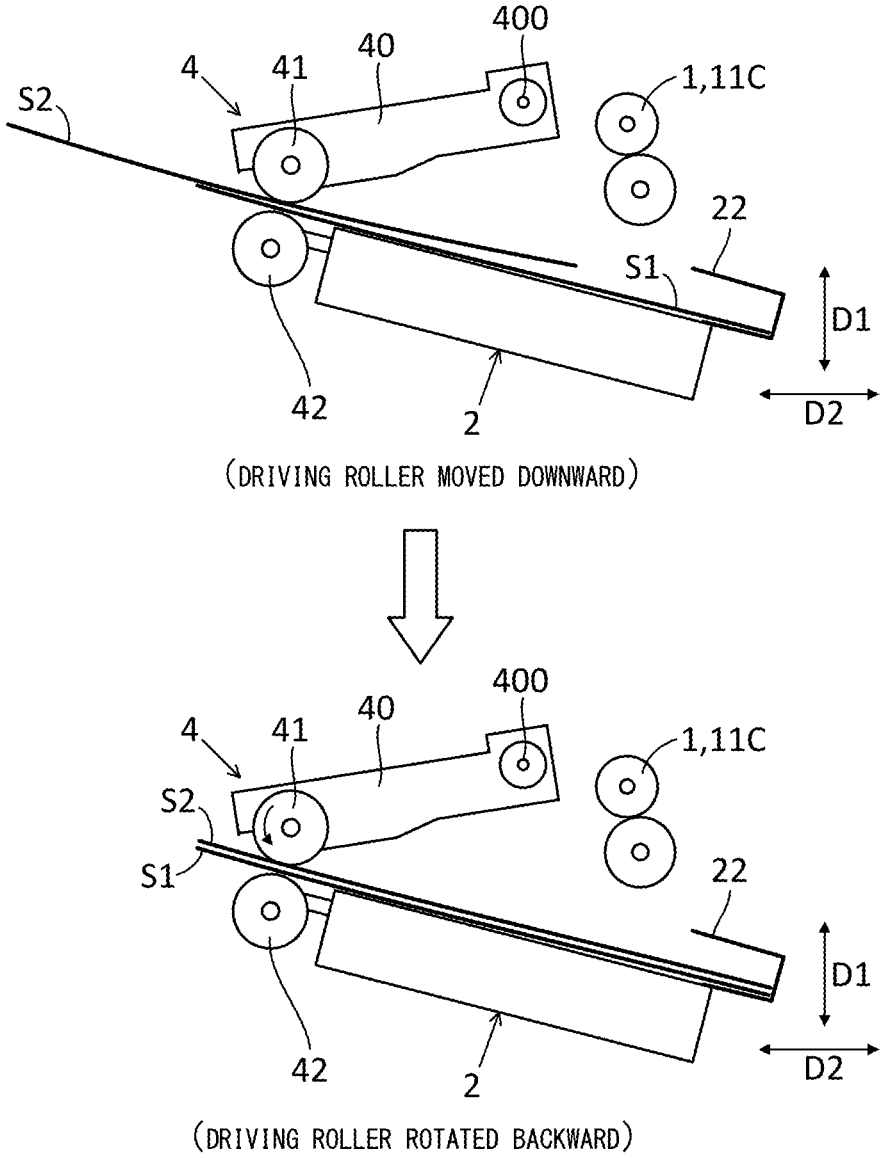
FIG. 4 is a diagram in illustration of a retraction process performed in the post-processing apparatus according to the embodiment.

Specifically, as shown in FIG. 4, at top, after the trailing edge of the second sheet S has passed through the pair of conveying rollers 11C in the conveyance portion 1, the control portion 5 moves the driving roller 41 downward such that the driving roller 41 is brought, from above, into contact with the sheet S having passed through the pair of conveying rollers 11C. This stops the advancement of the sheet S toward the discharge tray 10.

In addition, as shown in FIG. 4, at bottom, after (or substantially simultaneously with) bringing the driving roller 41 into contact with the second sheet S from above, the control portion 5 rotates the driving roller 41 backward. That is, the control portion 5 rotates the driving roller 41 in the direction (counterclockwise in FIG. 4) opposite to that when discharging the sheet S to the discharge tray 10. Thus, the sheet S is retracted onto the processing tray 2 and the second sheet S is stacked on the first sheet S. In FIG. 4, the first and second sheets S (i.e., the preceding and following sheets S) are distinguished with the numbers "1" and "2" appended to their reference signs respectively.

Then, while not shown, the control portion 5 moves the driving roller 41 upward to move the driving roller 41 apart from the topmost sheet S (here, the second sheet S) on the processing tray 2. In this state, the conveyance portion 1 conveys the third sheet S.

The retraction process on the third and subsequent sheets S is controlled in the same manner as the retraction process on the second sheet S. In this way, the sheets S are retracted successively onto the processing tray 2. That is, on the proceeding sheet S, the following sheet S is stacked. Note that the retraction process on the first sheet S can be controlled in the same manner as the retraction process on the second sheet S. That is, after the trailing edge of the first sheet S passes through the pair of conveying rollers 11C in the conveyance portion 1, the driving roller 41 can be moved downward to be brough into contact with the first sheet S from above and then it can be rotated backward.

The control portion 5 checks whether the number of sheets S stacked on the processing tray 2 has reached a target number. For example, the control portion 5 communicates with a main control portion (not shown) in the image forming apparatus 200 to recognize the target number. For example, the target number is the number of sheets in one copy. When the number of sheets S stacked on the processing tray 2 has reached the target number, the control portion 5 performs post-processing on the plurality of sheets S on the processing tray 2. That is, the control portion 5 performs post-processing on the bundle of sheets S on the processing tray 2.

With the driving roller 41 apart from the topmost sheet S on the processing tray 2, the control portion 5 performs post-processing on the bundle of sheets S on the processing tray 2. When a stapling process is performed as post-processing, the control portion 5 holds the bundle of sheets S on the processing tray 2 with the stapler 3 and drives a staple into the bundle of sheets S. If, after the stapling process as post-processing, a sorting process is performed, the control portion 5 moves the pair of cursors 21 along the front-rear direction to shift the post-processed bundle of sheets S on the processing tray 2 along the front-rear direction.

Then, the control portion 5 makes the discharge portion 4 perform a discharging process of discharging the post-processed bundle of sheets S on the processing tray 2 to the discharge tray 10. Note that, with the sheets S stacked on the processing tray 2, the leading edge parts of the sheets S on the processing tray 2 lie out of the processing tray 2, on the driven roller 42. That is, even with the sheets S stacked on the processing tray 2, the bundle of sheets S on the processing tray 2 can be nipped between the driving roller 41 and the driven roller 42.

When making the discharge portion 4 perform the discharging process, the control portion 5 moves the driving roller 41 downward to nip the bundle of sheets S on the processing tray 2 between the driving roller 41 and the driven roller 42. In other words, the control portion 5 brings the driving roller 41 into contact with the topmost sheet S on the processing tray 2 from above. In this state, the control portion 5 rotates the driving roller 41 forward. Thus, the bundle of sheets S on the processing tray 2 is discharged to the discharge tray 10.

In some cases, as post-processing, no stapling process is performed and only a sorting process is performed. In this case, the bundle of sheets S on the processing tray 2 is shifted along the front-rear direction and the discharging process is performed in a similar manner.

Downward Movement Speed of Driving Roller: When the sheet S is retracted onto the processing tray 2, that is, when the driving roller 41 is moved downward, if the downward movement speed of the driving roller 41 is too high, an inconvenience as shown in FIG. 5 may occur.

Figure 5:
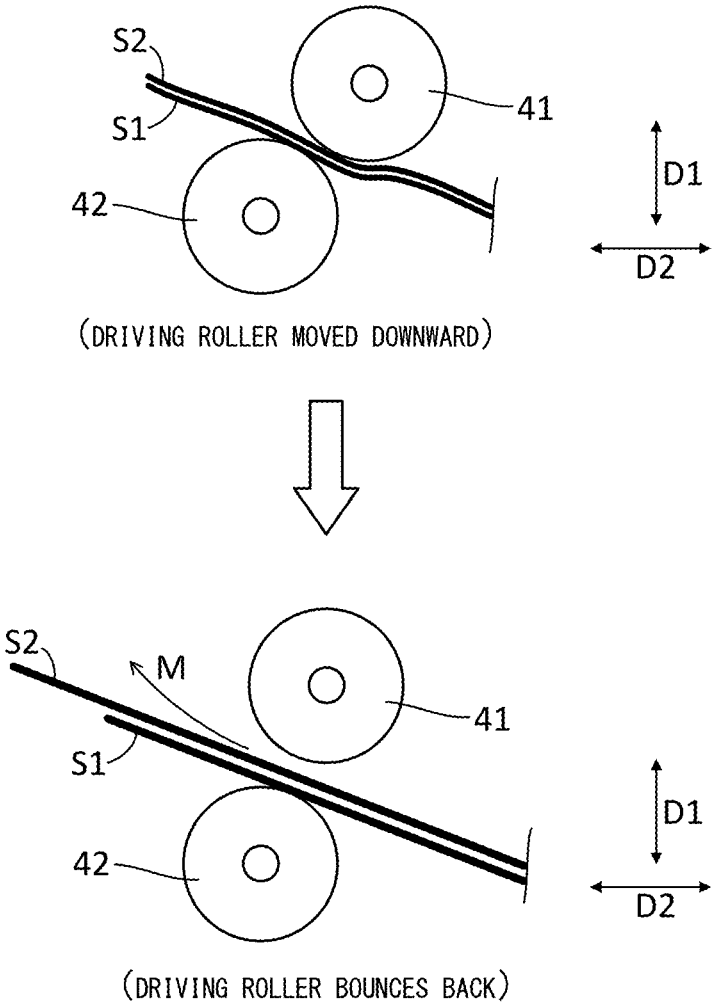
FIG. 5 is a diagram in illustration of a glitch that occurs when a driving roller of the post-processing apparatus according to the embodiment bounces back in the retraction process.

Specifically, as shown in FIG. 5, at top, when the driving roller 41 makes contact with the sheet S, the driving roller 41 pushes the sheet S down. Then, as shown in FIG. 5, at bottom, the driving roller 41 bounces back. That is, the driving roller 41 bounds. Then, as a reaction, the topmost sheet S (i.e., the sheet S in contact with the driving roller 41) moves in the direction indicated by arrow M, causing displacement of the sheet S on the processing tray 2. In FIG. 5, the lower sheet S is represented by the reference sign S1 and the sheet S on the sheet S1 is represented by the reference sign S2.

Here, when a stapling process is performed as post-processing on the bundle of sheets S on the processing tray 2, if a glitch as shown in FIG. 5 occurs, with some sheets S displaced from other sheets S, the staple is driven. This degrades the quality of the output result output (i.e., discharged) from the post-processing apparatus 100.

To cope with this, in the embodiment, the downward movement speed of the driving roller 41 is appropriately changed. Specifically, the control portion 5 goes through the procedure shown in FIG. 6.

Figure 6:
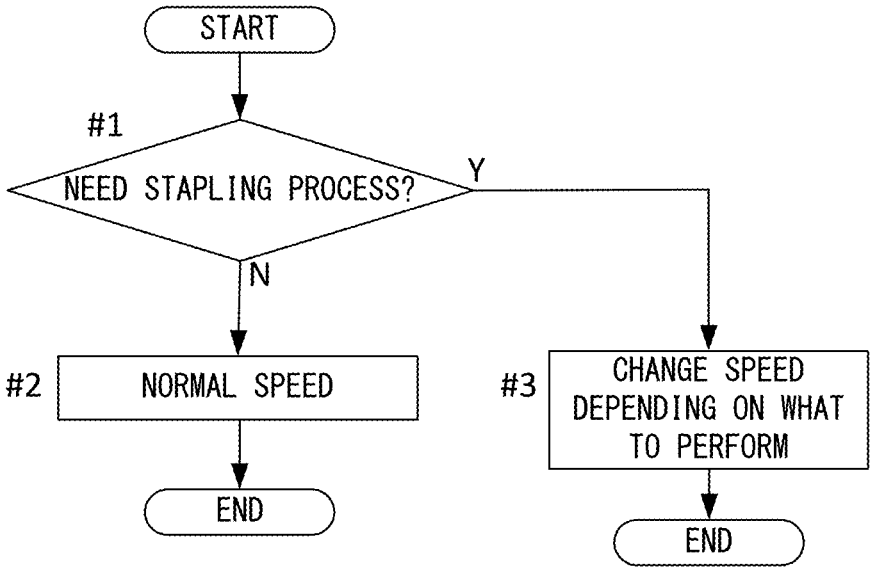
FIG. 6 is a flow chart of a procedure performed by a control portion of the post-processing apparatus in the embodiment.

Now, with reference to the flow chart shown in FIG. 6, the procedure performed by the control portion 5 will be described. The procedure shown in FIG. 6 starts when a printing job is started on the image forming apparatus 200 (i.e., when a sheet S is conveyed into the post-processing apparatus 100).

At step #1, the control portion 5 checks whether the current printing job is one involving a stapling process, that is, it judges whether to perform a stapling process on the sheet S conveyed into the post-processing apparatus 100. When the control portion 5 judges that no stapling process is needed, a transition is made to step #2. Note that the control portion 5 recognizes what to perform in the current printing job by communicating with the main control portion in the image forming apparatus 200.

If a transition is made to step #2, the control portion 5 sets the downward movement speed of the driving roller 41 to a predetermined normal speed. In other words, the control portion 5 sets, regardless of what to perform, the downward movement speed of the driving roller 41 to the normal speed. In this case, the downward movement speed of the driving roller 41 in a preparing process is the normal speed. Also, the downward movement speed of the driving roller 41 in the retraction process involving no stapling process (i.e., the retraction process involving only a sorting process on the processing tray 2) is the normal speed. Further, the downward movement speed of the driving roller 41 in a discharging process is the normal speed.

If at step #1, the control portion 5 judges that a stapling process is needed, a transition is made to step #3. If a transition is made to step #3, the control portion 5 changes, depending on what to perform, the downward movement speed of the driving roller 41. Specifically, except when the sheet S as the target of a stapling process is retracted onto the processing tray 2, the control portion 5 sets the downward movement speed of the driving roller 41 to the normal speed. On the other hand, when the sheet S as the target of a stapling process is retracted onto the processing tray 2, the control portion 5 sets the downward movement speed of the driving roller 41 to a low speed, that is, a speed lower than the normal speed.

If a transition is made to step #3, when the second and subsequent sheets S in the printing job are retracted onto the processing tray 2, the control portion 5 sets the downward movement speed of the driving roller 41 to the low speed. Note that, if the first sheet in the printing job is controlled in a similar manner to the second sheet, also when the first sheet S is retracted onto the processing tray 2, the downward movement speed of the driving roller 41 can be set to the low speed.

In the embodiment, when the driving roller 41 moves downward in a retraction process on the sheet S as the target of a stapling process, the driving roller 41 moves at the low speed. Thus, the driving roller 41 can be prevented from bouncing back when the driving roller 41 makes contact with the sheet S. The prevention of the bouncing-back of the driving roller 41 helps prevent the sheet S in contact with the driving roller 41 from moving together with the driving roller 41. Thus, it is possible to prevent displacement of the sheet S on the processing tray 2.

For the sake of discussion, if some sheets S on the processing tray 2 are displaced, and, in this state, a stapling process is performed, some of the sheets S in the output result bound with a staple are displaced from the other sheets S. This degrades the quality of the output result. On the other hand, preventing displacement of the sheets S on the processing tray 2 makes such a glitch less likely, preventing the degradation of the quality of the output result.

If the image forming apparatus 200 is an inkjet recording apparatus, there is strong friction between the sheets S stacked on the processing tray 2. Thus, if the upper sheet S is displaced from the lower sheet S, the upper sheet S is unlikely to move back to its original position. Thus, especially if the image forming apparatus 200 is an inkjet recording apparatus, it is preferable to prevent displacement of the sheet S on the processing tray 2.

In addition, in the embodiment, only when the sheet S as the target of a stapling process is retracted onto the processing tray 2 is the downward movement speed of the driving roller 41 set to the low speed. In a preparing process, a discharging process, and a retraction process involving only a sorting process on the processing tray 2, the downward movement speed of the driving roller 41 is set to the normal speed, that is, a speed higher than the low speed. This helps prevent an increase in the time required to output the output result from the post-processing apparatus 100. That is, it is possible to prevent a drop in the productivity of a job.

Settings According to the Number of Stacked Sheets:

If there are few sheets S stacked on the processing tray 2 (e.g., two or three sheets), if the driving roller 41 moves downward at a high speed and makes contact with the sheet S, the sheets S are easily pushed down. As a reaction, the sheets S are displaced a lot. Thus, preferably, the fewer the sheets S stacked on the processing tray 2, the lower the downward movement speed of the driving roller 41 is made.

Accordingly, in the embodiment, when the sheet S as the target of a stapling process is retracted onto the processing tray 2, the control portion 5 changes, depending on the number of sheets S stacked on the processing tray 2, the downward movement speed of the driving roller 41. Specifically, the fewer the sheets S stacked on the processing tray 2, the lower the control portion 5 makes the downward movement speed of the driving roller 41.

This configuration helps more effectively prevent displacement of the sheet S on the processing tray 2. Also, when there are plenty of sheets S stacked on the processing tray 2, the downward movement speed of the driving roller 41 is higher than when there are few and thus it is possible to prevent a drop in the productivity of a job.

In addition, in the embodiment, when the bundle of sheets S on the processing tray 2 is discharged to the discharge tray 10, the control portion 5 changes, depending on the number of sheets S stacked on the processing tray 2, the contact pressure of the driving roller 41 on the bundle of sheets S on the processing tray 2. Specifically, the more sheets S there are stacked on the processing tray 2, the higher the control portion 5 makes the contact pressure of the driving roller 41 on the bundle of sheets S on the processing tray 2. Note that, by controlling how far the driving roller 41 moves downward (in other words, how long the arm motor M1 drives to move the driving roller 41 downward), it is possible to change the contact pressure of the driving roller 41 on the bundle of sheets S on the processing tray 2.

With this configuration, when the bundle of sheets S on the processing tray 2 is discharged, regardless of the number of sheets S stacked on the processing tray 2 (i.e., even if the number of stacked sheets is large), the bundle of sheets S can be reliably nipped between the driving roller 41 and the driven roller 42. This allows the bundle of sheets S to be discharged reliably to the discharge tray 10.

The embodiment of the present disclosure should be understood to be in every aspect illustrative and not restrictive. The scope of the disclosure is defined not by the description of the embodiment given above but by the appended claims and encompasses any modifications made within a scope equivalent in significance to those claims.

What is claimed is:

1. A post-processing apparatus comprising:

a conveyance portion conveying a sheet;

a processing tray on which the sheet having passed through the conveyance portion can be stacked;

a post-processing portion that performs post-processing on the sheet on the processing tray;

a discharge tray to which the sheet is discharged;

a discharge portion disposed downstream of the conveyance portion in a sheet conveyance direction, the discharge portion discharging the sheet to the discharge tray; and a control portion controlling the discharge portion, wherein the discharge portion includes:

an arm pivotable such that, about a one end part thereof, another end part thereof being movable up and down;

a driving roller that is supported on the other end part of the arm so as to be rotatable, the driving roller making contact with the sheet from above and rotating forward so as to discharge the sheet to the discharge tray; and a driven roller disposed below the driving roller across a sheet conveyance passage, the driven roller nipping the sheet with the driving roller as the driving roller moves downward, when stacking the sheet on the processing tray, the control portion moves the driving roller downward to bring, from above, the driving roller into contact with the sheet having passed through the conveyance portion and rotates the driving roller backward so as to retract the sheet from a trailing edge thereof onto the processing tray, except when the sheet as a target of the post-processing is retracted onto the processing tray, the control portion sets a downward movement speed of the driving roller to a predetermined normal speed, and when the sheet as the target of the post-processing is retracted onto the processing tray, the control portion sets the downward movement speed of the driving roller to a speed lower than the normal speed.

2. The post-processing apparatus according to claim 1, wherein the post-processing portion is a stapler, and the stapler performs, as the post-processing, a stapling process on a bundle of the sheets on the processing tray.

3. The post-processing apparatus according to claim 1, wherein when the sheet as the target of the post-processing is retracted onto the processing tray, the control portion changes, depending on a number of the sheets stacked on the processing tray, the downward movement speed of the driving roller.

4. The post-processing apparatus according to claim 3, wherein the fewer the sheets stacked, the lower the control portion makes the downward movement speed of the driving roller.

5. The post-processing apparatus according to claim 1, wherein when the bundle of the sheets on the processing tray is discharged to the discharge tray, the control portion changes, depending on the number of the sheets stacked on the processing tray, a contact pressure of the driving roller on the bundle of the sheets on the processing tray.

6. The post-processing apparatus according to claim 5, wherein the more the sheets stacked, the higher the control portion makes the contact pressure of the driving roller on the bundle of sheets on the processing tray.

7. An image forming system comprising:

the post-processing apparatus according to claim 1; and an image forming apparatus forming an image on the sheet, wherein the post-processing apparatus performs the post-processing on the sheet conveyed therein from the image forming apparatus.

8. The image forming system according to claim 7, wherein the image forming apparatus is an inkjet recording apparatus and ejects ink onto the sheet to form the image on the sheet.

* * * * *